United States Patent [19]

Sato

[11] Patent Number: 5,012,045

[45] Date of Patent: Apr. 30, 1991

[54] CABLE WITH AN OVERALL SHIELD

[75] Inventor: Kazuhiro Sato, Tochigi, Japan

[73] Assignee: Sumitomo Electric Industries, Ltd., Osaka, Japan

[21] Appl. No.: 317,593

[22] Filed: Mar. 1, 1989

[30] Foreign Application Priority Data

Mar. 3, 1988 [JP] Japan ..... 63-50384
Jun. 14, 1988 [JP] Japan ..... 63-146578

[51] Int. Cl.[5] ..... H01B 7/34

[52] U.S. Cl. ..... 174/106 R; 174/109; 333/243

[58] Field of Search ..... 174/106 R, 109; 333/243

[56] References Cited

U.S. PATENT DOCUMENTS

| | | | |
|---|---|---|---|
| 2,028,793 | 1/1936 | Mascuch | 174/109 X |
| 2,141,290 | 12/1938 | Carlson et al. | 174/106 R |
| 2,438,146 | 3/1948 | Candee et al. | 174/109 |
| 2,623,918 | 12/1952 | Hartwell | 174/106 R |
| 3,215,768 | 11/1965 | Murphy | 174/106 R |
| 3,355,544 | 11/1967 | Costley et al. | 174/106 |
| 4,547,626 | 10/1985 | Pedersen et al. | 174/109 X |
| 4,552,989 | 11/1985 | Sass | 174/109 X |
| 4,701,575 | 10/1987 | Gupta et al. | 174/106 RX |
| 4,731,502 | 3/1988 | Finamore | 174/106 RX |
| 4,822,950 | 4/1989 | Schmitt | 174/109 X |

FOREIGN PATENT DOCUMENTS

| | | | |
|---|---|---|---|
| 1160521 | 1/1964 | Fed. Rep. of Germany | 174/109 |
| 102117 | 7/1988 | Japan . | |
| 121331 | 8/1988 | Japan . | |

*Primary Examiner*—Morris H. Nimmo
*Attorney, Agent, or Firm*—Cushman, Darby & Cushman

[57] ABSTRACT

A shielded cable comprising an assembly of one or more core wires and a shielding member comprising plural element wires around the assembly. The shield member has a single layer structure formed by braiding on the assembly the plural element wires each of which comprises a conductor of high conductivity and spun stainless steel strands woven around the conductor, or a double layer structure comprising two layers, one layer comprising a braid of plural element wires each of which comprises a spun stainless steel strand or spun stainless steel yarns woven around a conductor of high conductivity, and the other layer comprising a braid of plural soft copper wires or copper alloy wires.

7 Claims, 4 Drawing Sheets

CABLE WITH AN OVERALL SHIELD

BACKGROUND OF THE INVENTION

The present invention relates to a shielded cable having a plurality of conductive element wires braided to form an overally-shielding layer around an assembly of one or more insulated core wires, and more particularly to an improvement of braided conductors forming the shielding layer.

In a case where a conventional cable is used in applications where good shielding characteristics at high frequencies are required, it has been so designed that metallic element wires such as those made of tin-plated copper or tin-plated copper alloy are braided around an assembly of one or more insulated core wires to be accommodated in the cable. The shielded cable is also used in applications where not only good shielding characteristics but also high mechanical characteristics including flexibility and resistance to bending and elongation are required. These rigorous requirements cannot be satisfactorily met by the shielding member solely composed of braided metallic element wires because the breaking of these wires is unavoidable during service and the shielding effect is deteriorated .

On the other hand, with a view to providing improved mechanical characteristics, a multicore cable or coaxial having spun stainless steel strands braided to form an overall shield have been used commercially.

Ultrafine coaxial multicore cables for use in the wire harness of a medical instrument, a measuring instrument or the like are required to satisfy not only good mechanical characteristics such as flexibility and resistance to bending and elongation, but also good electrical characteristics such as effective shielding of extraneous electrical noise. Conventional shields composed of braided tin-plated copper or copper alloy wires are poor in mechanical characteristics. On the other hand, conventional shields in which spun stainless steel yarns are braided are so poor in electrical characteristics that they become considerably degraded in shielding effect at frequencies exceeding 1 MHz and at frequencies around 10 MHz, their shielding effect is no better than that of the unshielded multicore or coaxial cable. Particularly, shields solely composed of tin-plated copper or copper alloy wires have a good shielding effect, but they are so poor in mechanical characteristics that when placed under stresses such as bending, various phenomena will occur that render further use of the cable impossible, such as breaking of element wires in the braid, shorting due to contact between broken element wires and core wires in the cable, and breaking of core wires due to abrasion between braided element wires and the core assembly.

SUMMARY OF THE INVENTION

An object of the present invention is to provide a shielded cable that is free from the aforementioned problems of the prior art and which successfully satisfies both mechanical and electrical characteristics.

This object of the present invention can generally be attained by a shielded cable having a plurality of conductive element wires braided to form a shielding layer around an assembly of one or more insulated core wires, which is characterized in that a plurality of element wires each comprising spun stainless steel strands that are woven around a conductor of high conductivity to form a single wire are braided to form a shielding layer around the assembly of one or more insulated core wires.

The above object of the present invention can also be attained by a shielded cable having a plurality of conductive element wires braided to form a shielding layer around an assembly of one or more insulated core wires or co-axial core wires, which is characterized in that the overally-shielding layer has a double layer structure comprising the first shield layer and the second shield layer, the first shield layer comprising element wires each of which is a spun stainless steel strand or a single wire made by weaving spun stainless steel strand around a conductor of high conductivity, a plurality of the element wires being intertwined to form a braid, and the second shield layer comprising the braid of soft copper wires or copper alloy wires.

In a particularly effective embodiment, the second shield layer is formed by braiding tin-plated soft copper or copper alloy wires.

In a more effective embodiment, the element wires in the first shield layer which comprises spun stainless steel strands or those which are woven around a conductor of high conductivity to form a single wire are braided at an areal density which is deliberately adjusted to a minimum value sufficient to withstand mechanical impact, thereby providing a physical space between the second shield layer and the assembly of one or more insulated core wires or coaxial core wires confined in the cable.

DETAILED DESCRIPTION OF THE INVENTION

The shielded cable according to this invention includes not only a multicore cable having plural core wires, but also a coaxial cable having one core wire. The shielding member in the cable of the present invention comprises element wires of a dual structure in which spun stainless steel strands are woven around a good conductor. The spun stainless steel strands which are one component of the dual structure provide protection from abrasion that will occur between conductors as a result of cable bending, thereby preventing the conductors from breaking. The spun stainless strands cover all components of the cable, so that they also serve as a cushion member that protects one or more insulated core wires in the cable.

In a preferred embodiment of the present invention, the braid of which the shielding member is formed may be of a double layer structure where the first shield layer being composed of the braid of element wires which are made of either spun stainless steel strands or those which are woven around a conductor of high conductivity into a single wire, and the second shield layer comprises the braid of element wires having high conductivity such as soft copper or copper alloy wires with or without a tin plate. In this arrangement, the braid in the first shield layer which comprises spun stainless steel strands serves to retain high mechanical strength, while the braid in the second shield layer which comprises element wires having high electrical conductivity serves to retain good electrical characteristics, or good shielding characteristics.

The spun stainless steel strands constitute the braid in the first shield layer are braided at an areal density which is deliberately adjusted to a minimum value sufficient to withstand mechanical impact, thereby forming a physical space between the second shield layer and the assembly of one or more insulated core wires in the cable. This space is effective in preventing abrasion from occurring between the insulated core wire(s) in the cable and the element wires in the second shi.eld layer when the cable is subjected to external stresses such as bending, elongation and torsion.

On account of the protective action of the first shield layer, the shielded cable of the present invention, is capable of maintaining the shielding effect of the second shield layer at high level over a long period; in other words, this cable can have a long service life.

Preferred embodiments of the present invention will be described in detail with reference to the accompanying drawings.

Figure 1A:
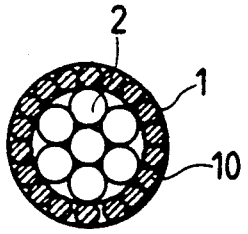
FIGS. 1A and 1B illustrate the construction of a multicore cable to which the present invention is applied.
Figure 1B:
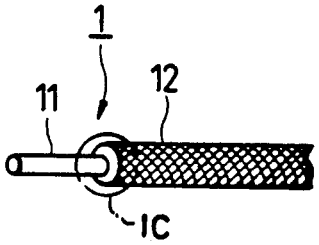

FIGS. 1A and 1B show the basic construction of a multicore cable to which the present invention is applied. FIG. 1A shows a cross sectional view of the cable in which a plurality of insulated core wires are accommodated. The cable as shown in FIG. 1A is a coaxial cable containing seven stranded units 2 each consisting of 16 insulated core wires. As shown in FIG. 1A, a braid 10 composed of element wires 1 for braiding (hereinafter referred to as "element wires") is formed around the assembly of units 2 to provide a shielding member.

FIG. 1B shows specifically the composition of a single element wire 1 for braiding. The wire has a dual structure in which spun stainless steel strands 12 are woven around a good conductor 11. A plurality of such dual-structure element wires 1 are braided around the assembly of insulated core wires as shown in FIG. 1A. When the cable is bent, abrasion occurs between conductors 11 but the spun stainless strands 12 in the braid 10 provide sufficient protection to prevent the conductors 11 from being broken.

As is apparent from the cross-sectional structure shown in FIG. 1A, the spun stainless steel strands 12 serving as one component of the element wires 1 in the braid 10 cover all the components of the cable and hence work collectively as a cushion member which protects the units 2 surrounded with the braid 10.

In combination with the capability of preventing the breaking of the element wires 1 as described above, the protecting ability of the shielded cable can maintain the desired shielding effect for a long period and therefore extend the useful file of the cable.

Figure 1C:
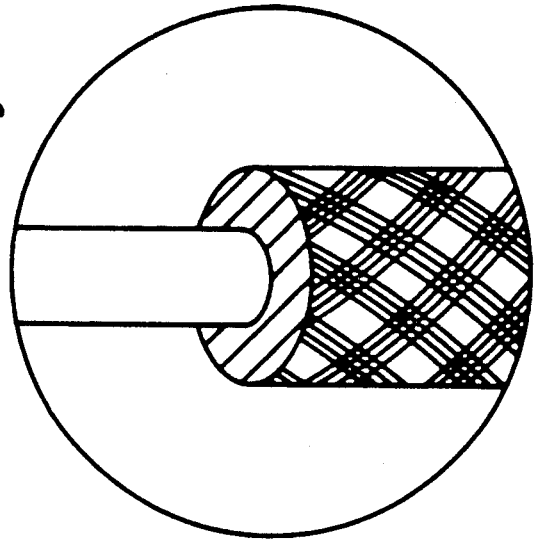
Figure 4A:
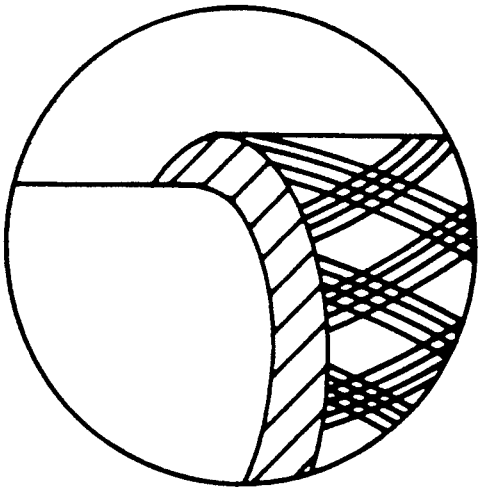
Figure 4B:
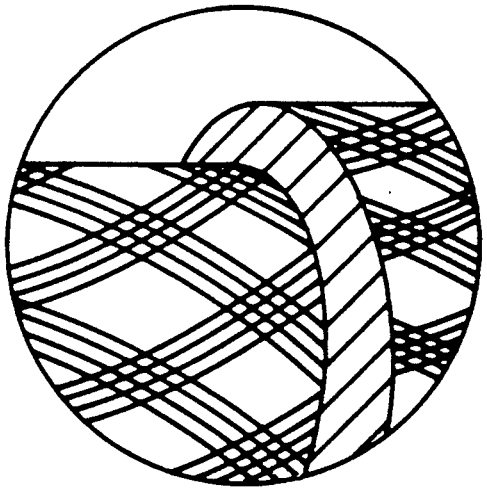
Figure 4C:
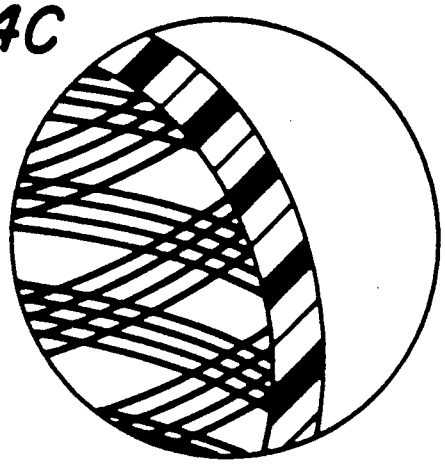

A specific example of the embodiment shown in FIG. 1 will be described hereinafter. A cable containing units each comprising 100 insulated core wires was furnished with a braid according to the present invention under the following conditions: the number of picks, 24; the number of carriers, 4; pitch, 125 mm; angle, 78 degrees; and braiding density, ca. 90 %. This cable sample was evaluated for the effectiveness of the shielding member by measuring the voltage that developed in the core wires in the cable core when a signal voltage was applied to a copper pipe through which the cable was inserted.

Figure 2A:
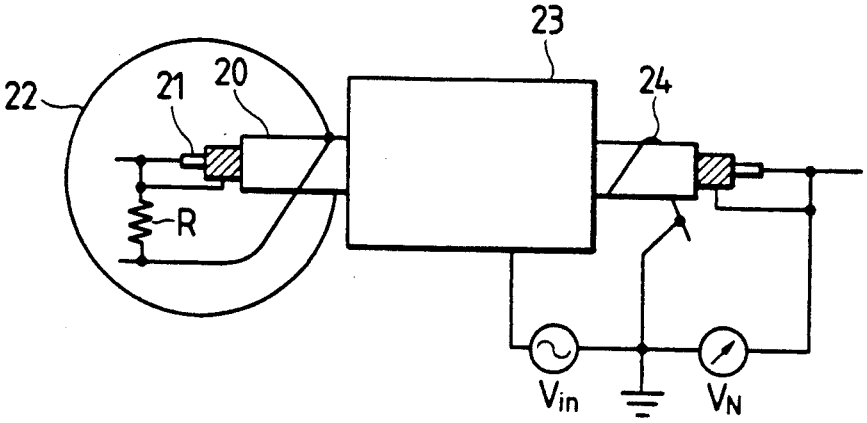
FIGS. 2A and 2B are schematic diagrams showing a method of evaluating the effectiveness of an shielding member.
Figure 2B:
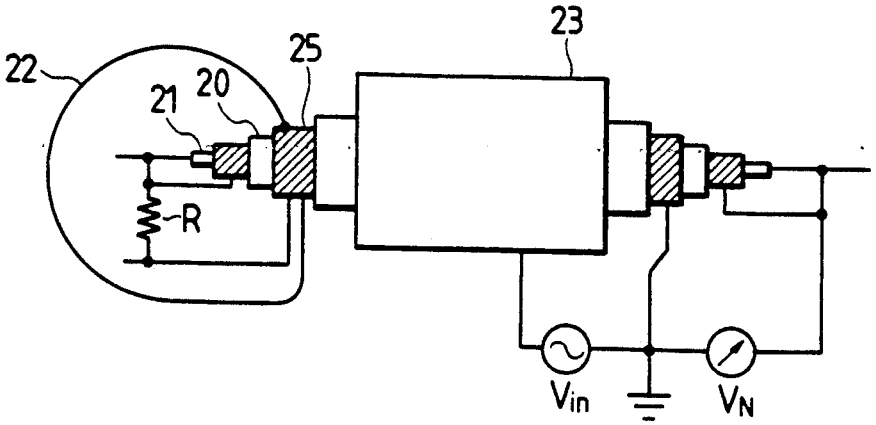

FIGS. 2A and 2B show schematically the method for evaluating the effectiveness of the shielding member. FIG. 2A shows the arrangement for comparison in which the cable is unshielded. In this case, instead of a shield, a drain wire 24 is wound spirally around the cable 20 in a measuring circuit. The cable 20 having a length of 800 mm is inserted through a copper pipe 23 having an inner diameter of 25 mm and a length of 500 mm. One end of the cable core 21 is terminated with a 75Ωresistance R and shielded with an aluminum foil 22. The circuit also includes an apparatus ($V_{in}$) for applying a signal voltage to the copper pipe 23, and an apparatus ($V_N$) for measuring the voltage developed in the cable core 21. Commercial apparatus may be employed; for example, $V_{in}$ may be HP 8444A OPT059 Tracking Generator or HP-3325A-Synthesizer Function Generator, and $V_N$ may be HP8568B-Spectrum Analyzer or HP9000-216 Controller.

FIG. 2B is a schematic diagram showing the configuration of a measuring circuit for evaluating the effectiveness of a shielding layer 25 applied to the same cable as that shown in FIG. 2A.

In order to reconfirm the effectiveness of the present invention, a shielded cable was fabricated in which the shield was solely composed of the braid of spun stainless steel strands as in the prior art and its shielding effect was evaluated by the circuit shown in FIG. 2B.

Figure 3:
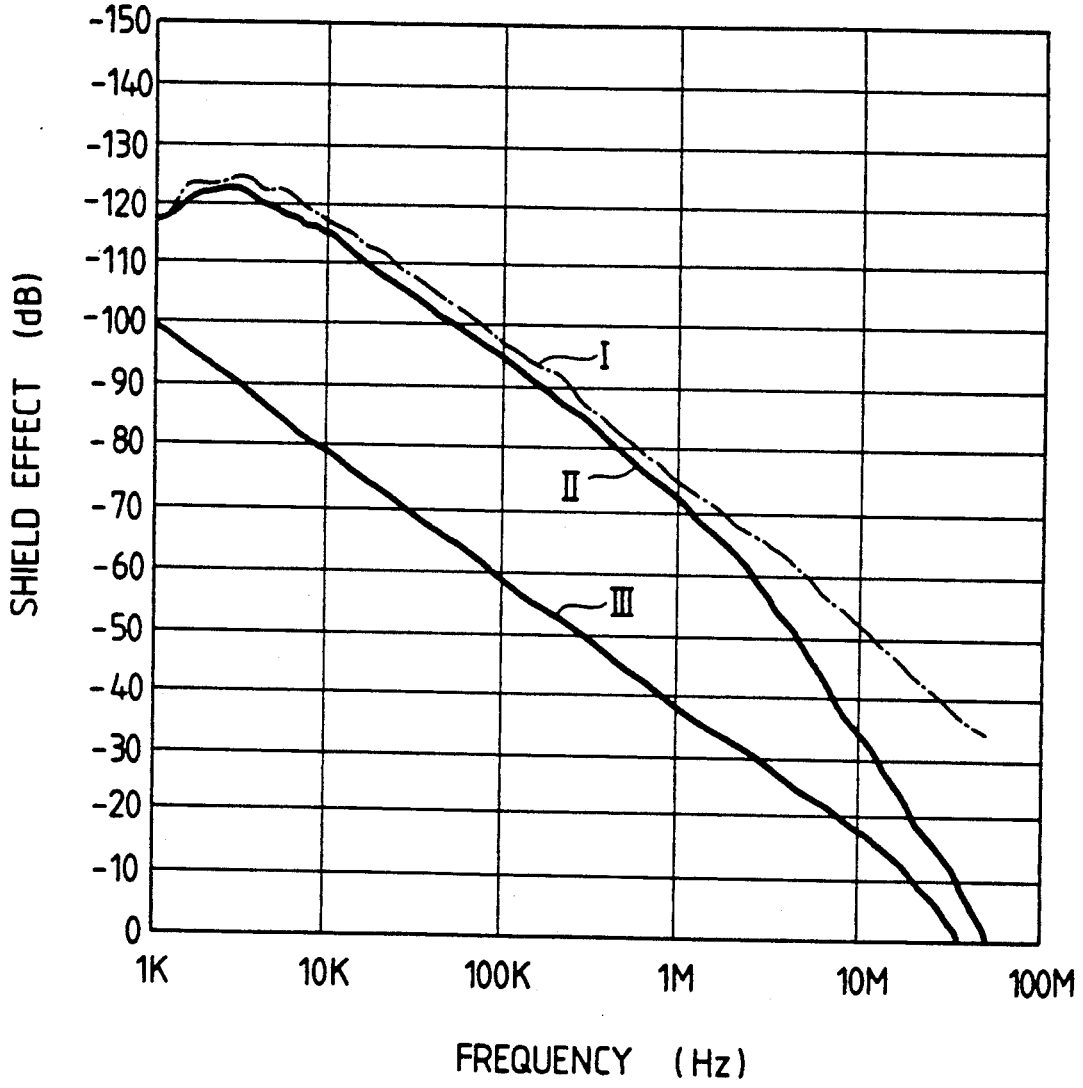
FIG. 3 is a graph showing the results of evaluation of the effectiveness of a shielding member.

The results of measurements are shown in FIG. 3. As is apparent from FIG. 3, the shielded cable of the present invention whose shielding characteristics are indicated by curve I attained good results over the entire range of measuring frequencies in comparison with the unshielded cable whose shielding characteristics are indicated by curve III. This is also true in comparison with the conventional shielded cable (i.e., the shielding member was solely composed of the braid of spun stainless steel yarns) whose shielding characteristics are indicated by curve II. At frequencies higher than 1 MHz, the characteristics shown by curve II deteriorated markedly but those shown by curve I maintained the slope for the low-frequency range.

The cable sample of the present invention was tested for its mechanical strength by subjecting it to stresses including elongation, torsion and bending. The test results showed that the cable had a strength comparable to that of the prior art sample. After the mechanical test, the sample was again evaluated for its shielding effect and the results were comparable to those attained before the test. It was therefore established that the shielded cable of the present invention satisfy the requirements of both electrical and mechanical characteristics.

The foregoing description concerns the case where the shielding member of the present invention is of a single layer structure. It should also be noted that the concept of the present invention is effective even if the shielding member is of a double layer structure as described below.

Figure 4:
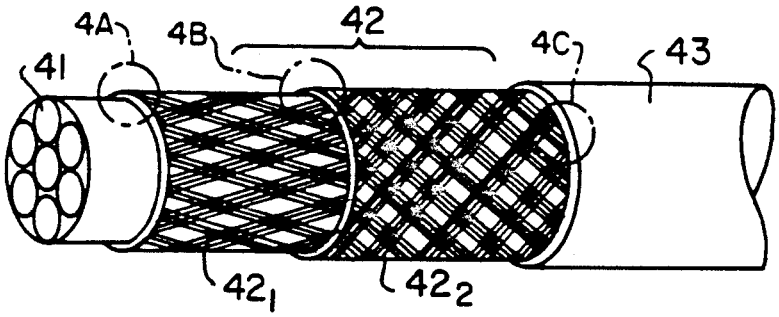
FIG. 4 illustrates the construction of a shielding member having a double layer structure according to an embodiment of the present invention.

FIG. 4 shows the composition of an shielded multicore cable according to another embodiment of the present invention in which the shielding member has a double layer structure. Reference numeral 41 designates a coaxial cable having a core wire. In this case, seven units each consisting of 16 core wires are stranded to form an assembly. The shielding member represented by 42 comprises the first shield layer $42_1$ and the second shield layer $42_2$. The first shield layer $42_1$ is in the form of the braid of element wires each of which comprises a spun stainless steel strand or spun stainless strands woven around a conductor of high conductivity to form a single wire. Because of their fairly flexible nature, the spun stainless steel strands will not break upon bending and also serve collectively as a cushion member for protecting the assembly of coaxial cables 41. Reference numeral 43 represents a jacket or outer covering.

In order to enhance the tensile characteristics of the cable, the first shield layer $42_1$ comprises element wires that have been intertwined coarsely (at a large pitch) to form a low-density braid. As a result, gaps are formed between the braid in the second shield layer $42_2$ and the assembly of coaxial cables 41, thereby preventing abrasion from occurring between the cable assembly and the element wires for braiding in the second shield layer $42_2$ even if the cable is bent. The braid in the second shield layer $42_2$ comprises optionally tin-plated soft copper or copper alloy wires which are intertwined at a sufficiently high density to ensure satisfactory electrical characteristics. In spite of their high braiding density, the element wires in the second shield layer $42_2$ are protected against breaking by virtue of the first shield layer $42_1$ which prevents the occurrence of abrasion between those element wires and the cable assembly. As a consequence, the shielding member remains effective for a long period and thus extends the useful life of the cable.

A specific example of the embodiment shown in FIG. 4 will be described hereinafter. A multicore (ca. 130 core wires) cable was furnished with a braid of the composition shown in FIG. 4. The first shield layer was formed by intertwining spun stainless steel strands under the following conditions: the number of picks, 16; the number of carriers, 3; pitch, 75 mm; angle, 72 degrees; and braiding density, ca. 50 %. The second shield layer was formed by intertwining tin-plated soft copper wires under the following conditions: the number of picks, 24; the number of carriers, 17; pitch, 56 mm; angle 67 degrees; and braiding density, ca. 90 %.

Figure 5:
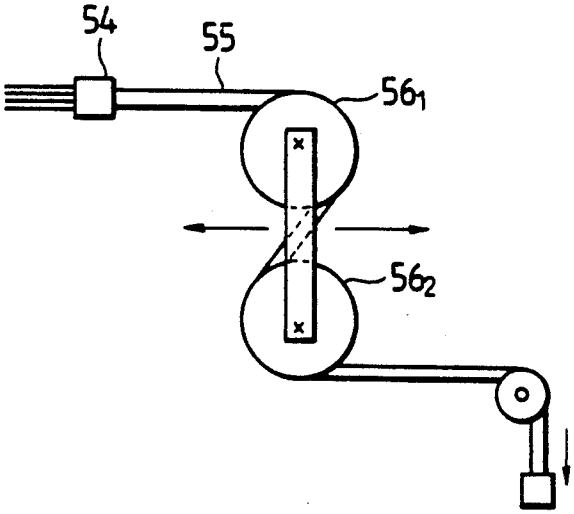
FIG. 5 is a schematic diagram showing a method of testing the mechanical strength of a cable.

The cable sample thus fabricated was tested for its mechanical strength by the method shown schematically in FIG. 5 using two movable rollers $56_1$ and $56_2$ each of which has an inner diameter of 11 mm and reciprocates in the directions indicated by arrows through a stroke of 400 mm at a speed of 50 times per minute. The center-to-center distance of the rollers was 150 mm. As shown in FIG. 5, a sample cable 55 was disposed between the rollers $56_1$ and $56_2$ in such a manner that its left end was fixed to a fastener 54 and its right end was stretched downwardly in the direction indicated by an arrow by means of a load F fitted with a 3-kg weight. With care being taken to ensure electrical conduction between individual conductors in the cable, all of which were connected in series, the rollers $56_1$ and $56_2$ were reciprocated until a conductor broke.

By the method described above, three specimens were tested for each of a conventional shielded cable whose shield was solely composed of a single layer of the braided tin-plated soft copper wires and a shielded cable having a double layered shielding member according to the present invention to measure their strength. The results were evaluated by counting the number of reciprocations that could be performed on the rollers until a conductor broke. The specimens of the conventional cable experienced breaking after 4000 to 6000 reciprocations whereas the specimens of the cable of the present invention successfully withstood more than $2 \times 10^6$ reciprocations without breakage of conductors.

After the test, the shielding member of the specimens of the cable of the present invention was examined but neither damage to the core wires in the cable nor breaking of element wires in the shielding member was observed.

As described above, the shielded multicore cable of the present invention has a shielding member in which spun stainless strands are woven around a good conductor having high dielectric constant to form a single element wire of a dual structure and a plurality of such element wires are braided around an assembly of one or more core wires in the cable. The spun stainless steel strands provide protection against breaking of conductors in the braid that would otherwise occur on account of abrasion upon cable bending. Further, the shielding member can maintain stably shielding effects over a broad frequency range for a long period. In addition, the spun stainless steel strands cover all the components of the cable and hence are effective in extending the useful life of the cable by providing cushioning effects which protect the insulated electric wires in the cable.

In accordance with another aspect of the present invention, a shielding member having a double layer structure can be applied to the peripheral surface of an assembly of one or more insulated core (or co-axial core) wires. The first shield layer comprises spun stainless steel strands which are braided at low density and the second shield layer comprises metallic conductors braided at high density. In this arrangement, the braid forming the first shield layer serves three purposes, i.e., retention of good mechanical characteristics, protection of the assembly of one or more core wires in the cable, and prevention of breaking of element wires in the second shield layer. As a result, the electrical characteristics of the cable are effectively shielded from unwanted electromagnetic induction for a long time by virtue of the second shield layer while at the same time, the cable maintains satisfactory mechanical characteristics.

For these features, the shielded cable of the present invention offers great benefits when it is used in wire harnessing of various medical diagnostic apparatus requiring not only good electrical characteristics sufficient to insure high device performance and resolution, but also sufficient strength to withstand the handling that is to be encountered in routine medical activities.

Furthermore, in the light of the more recently envisaged requirement for a reduction in the diameter of this type of cable (which results in the increase of a load up to several kilograms per unit cross-sectional area of the cable), the advantage of the cable of the present invention is particularly notable in that it will provide a small-diameter cable that exhibits good electrical characteristics and which is rugged enough to withstand external impacts, thereby allowing a medical diagnostic apparatus to perform reliably in its application.

What is claimed is:

1. A shielded cable, comprising:

an assembly of one or more core wires; and a shielding member including a plurality of element wires braided around said assembly, each of said element wires comprising:

a conductor of high conductivity; and stainless steel strands woven around said conductor.

2. A shielded cable as claimed in claim 1, further comprising insulating covers surrounding each of said core wires.

3. A shielded cable, comprising:

an assembly of one or more core wires; and a shielding member, said shielding member including;

a first shield member disposed around said assembly, said first shield member including a plurality of element wires braided around said assembly, each of said element wires including a conductor of high conductivity, and stainless steel strands woven around said conductor; and a second shield member disposed around said first shield member, said second shield member including a plurality of wires made of a material having a high conductivity braided around said first shield member.

4. A shielded cable as claimed in claim 3, wherein said wires of said second shielding member are made of tin plated copper.

5. A shielded cable as claimed in claim 3, wherein said wires of said second shielding member are made of tin plated copper alloy.

6. A shielded cable as claimed in claim 3, wherein said element wires in said first shield member are braided coarsely so that gaps are formed between said second shield layer and said assembly to thereby withstand external impact without damage.

7. A shielded cable as claimed in claim 3, wherein said core wires have an insulating cover.

* * * * *